US006791516B2

(12) United States Patent
Kang

(10) Patent No.: US 6,791,516 B2
(45) Date of Patent: Sep. 14, 2004

(54) METHOD AND APPARATUS FOR PROVIDING A GRAY LEVEL IN A PLASMA DISPLAY PANEL

(75) Inventor: Seong Ho Kang, Taegu-shi (KR)

(73) Assignee: LG Electronics Inc., Seoul (KR)

( * ) Notice: Subject to any disclaimer, the term of this patent is extended or adjusted under 35 U.S.C. 154(b) by 243 days.

(21) Appl. No.: 10/046,276

(22) Filed: Jan. 16, 2002

(65) Prior Publication Data

US 2002/0130825 A1 Sep. 19, 2002

(30) Foreign Application Priority Data

Jan. 18, 2001 (KR) ..... P2001-002996
Jan. 7, 2002 (KR) ..... P2002-000668

(51) Int. Cl.[7] ..... G09G 3/28
(52) U.S. Cl. ..... 345/63; 345/67; 345/68
(58) Field of Search ..... 345/63, 67, 68, 345/60, 693, 690, 691; 348/671

(56) References Cited

U.S. PATENT DOCUMENTS 6,388,678 B1 * 5/2002 Kasahara et al. ..... 345/693
6,396,508 B1 * 5/2002 Noecker ..... 345/63
2002/0053883 A1 * 5/2002 Choi ..... 315/169.3
2002/0084953 A1 * 7/2002 Yoon et al. ..... 345/60

FOREIGN PATENT DOCUMENTS

JP 11065517 3/1999

OTHER PUBLICATIONS

Korean Office Action dated Mar. 5, 2004 (No translation currently available).

* cited by examiner

*Primary Examiner*—Joseph Mancuso
*Assistant Examiner*—Laurel E. LeFlore
(74) *Attorney, Agent, or Firm*—Fleshner & Kim, LLP

(57) ABSTRACT

A method and apparatus for expressing a gray level with a decimal value in a plasma display panel that is capable of enhancing a picture quality. In the method and apparatus, a sustaining pulse is applied only to any one electrode of a sustaining electrode pair to thereby express a gray level with a decimal value.

22 Claims, 7 Drawing Sheets

METHOD AND APPARATUS FOR PROVIDING A GRAY LEVEL IN A PLASMA DISPLAY PANEL

BACKGROUND OF THE INVENTION

1. Field of the Invention

This invention relates to a gray level expression method for a plasma display panel, and more particularly to a method and apparatus for expressing a gray level with a decimal value in a plasma display panel that is capable of enhancing a picture quality.

2. Description of the Related Art

Generally a plasma display panel (PDP) radiates light from phosphors excited by an ultraviolet ray generated during a gas discharge, thereby displaying a picture including characters and graphics. Such a PDP is easy to be made into a thin-film and large-dimension type. Moreover, the PDP provides a very improved picture quality owing to a recent technical development.

Referring to FIG. 1, a conventional three-electrode, AC surface-discharge PDP, which is hereinafter referred to as "three-electrode PDP", includes a scanning electrode Y and a sustaining electrode Z provided on an upper substrate 10, and a data electrode X provided on a lower substrate 18.

The scanning electrode Y and the sustaining electrode Z have transparent electrodes 12Y and 12Z with a large width and metal bus electrodes 13Y and 13Z with a small width, respectively, and are formed on the upper substrate in parallel. An upper dielectric layer 14 and a protective film 16 are disposed on the upper substrate 10 in such a manner to cover the scanning electrode Y and the sustaining electrode Z. Wall charges generated upon plasma discharge are accumulated in the upper dielectric layer 14. The protective film 16 prevents a damage of the upper dielectric layer 14 caused by a sputtering during the plasma discharge and improves the emission efficiency of secondary electrons. This protective film 16 is usually made from magnesium oxide (MgO). The data electrode X is crossed to the scanning electrode Y and the sustaining electrode Z.

A lower dielectric layer 22 and barrier ribs 24 are formed on the lower substrate 19. The surfaces of the lower dielectric layer 22 and the barrier ribs 24 are coated with a fluorescent material layer 26. The barrier ribs 24 separate discharge spaces being adjacent to each other in the horizontal direction to thereby prevent optical and electrical crosstalk between adjacent discharge cells. The fluorescent layer 26 is excited by an ultraviolet ray generated during the plasma discharge to generate any one of red, green and blue visible light rays. An inactive mixture gas of He+Xe, Ne+Xe or He+Xe+Ne is injected into a discharge space defined between the upper and lower substrate 10 and 18 and the barrier rib 24.

In a PDP, one frame is divided into a plurality of sub-fields which are different from each other in the number of discharge, so as to realize gray levels of a picture. Each sub-field is again divided into a reset period for uniformly causing a discharge, an address period for selecting the discharge cell and a sustaining period for realizing the gray levels depending on the discharge frequency.

For instance, when it is intended to display a picture of 256 gray levels, a frame equal to 1/60 second (i.e. 16.67 msec) is divided into 8 sub-fields SF1 to SF8 as shown in FIG. 2. Each of the 8 sub-fields SF1 to SF8 is again divided into a reset period, an address period and a sustaining period. The reset period and the address period of each sub-field are equal every sub-field. The address discharge for selecting the cell is caused by a voltage difference between the data electrode X and the scanning electrode Y. The sustaining period is increased at a ration of $2^n$ (wherein n=0, 1, 2, 3, 4, 5, 6 and 7) at each sub-field. A sustaining discharge frequency in the sustaining period is controlled at each sub-field in this manner, to thereby realize gray levels.

FIG. 3 illustrates driving waveforms applied to the scanning electrode Y, the sustaining electrode Z and the data electrode X at the first to third sub-fields having a low brightness weighting value.

Referring to FIG. 3, a reset period for initializing a panel is assigned at an initial time of the frame. In the reset period, a high positive reset pulse RST is applied to the sustaining electrode Z to cause a reset discharge within cells of the panel. Since this reset discharge allows wall charges to be uniformly accumulated in the cells of the panel, a discharge characteristic becomes uniform.

Each of the first to third sub-fields SF1 to SF3 includes an address period, a sustaining period and an erase period. Herein, the address periods and the erase periods are set equally, whereas the sustaining periods become different depending upon a brightness weighting value given to each sub-field SF1 to SF3.

The first sub-field SF1 has a brightness weighting value set to $2^0$. In the address period of the first sub-field SF1, a data pulse DATA is applied to the address electrode X and a scanning pulse-SCN is sequentially applied to the scanning electrode Y in such a manner to be synchronized with the data pulse DATA. A voltage difference between the data pulse DATA and the scanning pulse-SCN is added to a wall voltage within the cells, thereby allowing the cells supplied with the data pulse DATA to cause an address discharge. In the sustaining period of the first sub-field SF1, a sustaining pulse is once applied to each of the scanning electrode Y and the sustaining electrode Z in correspondence with the brightness weighting value '$2^0$'. The cells selected in the address period are discharged for each sustaining pulse while the sustaining pulse being added to an internal wall voltage to thereby have total twice discharge. In the erase period of the first sub-field SF1, an erase signal ERASE with a shape of ramp wave is applied to all the scanning electrodes Y. This erase signal ERASE erases a sustaining discharge and uniformly forms a certain amount of wall charges within the cells of the panel.

The second sub-field SF2 has a brightness weighting value set to $2^1$ while the third sub-field SF3 has a brightness weighting value set to $2^2$. The address periods of the second and third sub-fields SF2 and SF3 cause an address discharge within the cells supplied with the data pulse DATA in similarity to that of the first sub-field SF1 to select the cell. In the sustaining period of the second sub-field SF2, a sustaining pulse is twice applied to each of the scanning electrode Y and the sustaining electrode Z in correspondence with the brightness weighting value '$2^1$'. In the sustaining period of the third sub-field SF3, a sustaining pulse is four times applied to each of the scanning electrode Y and the sustaining electrode Z in correspondence with the brightness weighting value '$2^2$'. Accordingly, total four times discharge are generated at each of the cells selected by an address discharge in the sustaining period of the second sub-field SF2, whereas total eight times discharge are generated at each of the cells selected by an address discharge in the sustaining period of the third sub-field SF3.

The conventional PDP driving method has a problem in that it is unable to express a gray level less than 1. More specifically, the conventional PDP expresses a gray level with an integer value by a combination of sub-fields, to each of which a brightness weighting value of an integer is set, as seen from the following Table 1. A brightness weighting value of each sub-field becomes equal to the number of sustaining pulse pairs.

The following Table represents on/off of the sub-field according to a gray level value in the case of 8-bit default code.

TABLE 1

| | SF1 (1) | SF2 (2) | SF3 (4) | SF4 (8) | SF5 (16) | SF6 (32) | SF7 (64) | SF8 (128) |
|---|---|---|---|---|---|---|---|---|
| 0 | x | x | x | x | x | x | x | x |
| 1 | 0 | x | x | x | x | x | x | x |
| 2 | x | 0 | x | x | x | x | x | x |
| 3 | 0 | 0 | x | x | x | x | x | x |
| 4 | x | x | 0 | x | x | x | x | x |
| . | . | . | . | . | . | . | . | . |
| . | . | . | . | . | . | . | . | . |
| . | . | . | . | . | . | . | . | . |
| 126 | x | 0 | 0 | 0 | 0 | 0 | 0 | x |
| 127 | 0 | 0 | 0 | 0 | 0 | 0 | 0 | x |
| 128 | x | x | x | x | x | x | x | 0 |
| . | . | . | . | . | . | . | . | . |
| . | . | . | . | . | . | . | . | . |
| . | . | . | . | . | . | . | . | . |
| 252 | x | x | 0 | 0 | 0 | 0 | 0 | 0 |
| 253 | 0 | x | 0 | 0 | 0 | 0 | 0 | 0 |
| 254 | x | 0 | 0 | 0 | 0 | 0 | 0 | 0 |
| 255 | 0 | 0 | 0 | 0 | 0 | 0 | 0 | 0 |

In the Table 1, the uppermost row represents sub-fields, and their brightness weighting values and the leftmost column represents the number of sub-field pairs. Further, '0' means turned-on sub-fields SF1 to SF8 while 'x' means turned-off sub-fields.

As can be seen from the Table 1, the conventional PDP cannot express a gray level with a value of less than 1. Particularly, if an input image signal undergoes an inverse gamma correction, then it becomes impossible for the PDP to express a part of low gray levels in the input image signal because low gray levels, for example, gray levels smaller than '21' are changed into gray level values less than '1' as shown in FIG. 4. Also, if an input image signal undergoes an error diffusion after the inverse gamma correction, then a data converted into a gray level value less than '1' by the inverse gamma correction is displayed by so-called "error diffusion artifact" acting as a point pattern noise due to an error diffusion component diffused into the adjacent cells. As a result, if an input image having a dark object moved within a field having a dark background is displayed on the PDP, then it becomes impossible to exactly identify a shape of the dark object because the moving dark object is displayed by error diffusion artifact.

Recently, there has been developed a driving system of controlling the total number of sustaining pulses depending upon an average brightness of an input image. As seen from the following Table 2, this average image control system reduces the total number of sustaining pulses with respect to any one of sub-field arrangements with a different number of total sustaining pulses when an average brightness of an input image is high, whereas it enlarges the total number of sustaining pulses when an average brightness of an input image is low. Likewise, in this case, if a field having a high average brightness undergoes an inverse gamma correction and an error diffusion, then it becomes impossible to express a decimal value of gray levels, particularly, gray levels less than 1.

TABLE 2

| | SF1 | SF2 | SW3 | SF4 | SF5 | SF6 | SF7 | SF8 | SF9 | SF10 |
|---|---|---|---|---|---|---|---|---|---|---|
| 1023 | 1 | 2 | 4 | 8 | 16 | 32 | 64 | 128 | 256 | 1512 |
| 511 | — | 1 | 2 | 4 | 8 | 16 | 32 | 64 | 128 | 256 |
| 255 | — | — | 1 | 2 | 4 | 8 | 16 | 32 | 64 | 128 |

In the Table 2, the uppermost row represents sub-fields, and the leftmost column represents the total number of sustaining pulse pairs. As can be seen from the Table 2, if the number of sustaining pulse pairs is 255, then it becomes impossible to express a decimal value of gray levels.

SUMMARY OF THE INVENTION

Accordingly, it is an object of the present invention to provide a method and apparatus for expressing a gray level with a decimal value in a plasma display panel that is adaptive for enhancing a picture quality In order to achieve these and other objects of the invention, in a method of expressing a gray level in a plasma display panel according to one aspect of the present invention, a sustaining pulse is applied only to any one electrode of a sustaining electrode pair, thereby expressing a gray level with a decimal value.

In the method, a sub-field for expressing said gray level with a decimal value includes an erase period for applying an erase signal to other sustaining electrode opposed to the sustaining electrode supplied with the sustaining pulse to erase said discharge.

A sub-field for expressing said gray level with a decimal value includes a reset period for initializing a panel.

A sub-field for expressing said gray level with a decimal value is given by a brightness weighting value less than 1.

In a method of expressing a gray level in a plasma display panel according to another aspect of the present invention, at least one sub-field in which said sustaining period is omitted to include a gray level with a decimal value is provided.

In the method, the sub-field for expressing said gray level with a decimal value includes a reset period for initializing a panel.

The sub-field for expressing said gray level with a decimal value includes an address period to express its brightness only by a light emission followed by said address discharge.

The sub-field for expressing said gray level with a decimal value is given by a brightness weighting value less than 1.

A method of expressing a gray level with a decimal value in a plasma display panel according to still another aspect of the present invention includes the steps of determining the number of first sustaining pulses corresponding to a fixed number gray level 'n' (wherein n is an integer); determining the number of second sustaining pulses corresponding to a fixed number gray level 'n+1'; and determining the number of third sustaining pulses corresponding to a gray level with a decimal value between said fixed number gray levels 'n' and 'n+1' to go between the number of first sustaining pulses and the number of second sustaining pulses.

A method of expressing a gray level with a decimal value in a plasma display panel according to still another aspect of the present invention includes the steps of determining the number of first sustaining pulses corresponding to a first sustaining electrode; determining the number of second sustaining pulses corresponding to a second sustaining electrode making a pair with respect to the first sustaining electrode to be different from the number of first sustaining pulses; and applying the first sustaining pulses to the First sustaining electrode and applying the second sustaining pulses to the second sustaining electrode to express a gray level with a fixed number value and a gray level with a decimal value.

An apparatus for expressing a gray level with a decimal value in a plasma display panel according to still another aspect of the present invention includes said plasma display panel having a sustaining electrode pair for causing a sustaining discharge with respect to a selected cell; and sub-field mapping means for mapping a data with a decimal gray level on a sub-field having a sustaining pulse assigned only to any one electrode of said sustaining electrode pair.

The apparatus further includes means for making an inverse gamma correction of an input image; means for making an error diffusion of the inverse gamma corrected image; and an average picture level controller for detecting an average brightness of said input image and determining the number of sustaining pulses depending upon said average brightness to thereby control the sub-field mapping means.

An apparatus for expressing a gray level with a decimal value in a plasma display panel according to still another aspect of the present invention includes sub-field mapping means for mapping an image data with a decimal gray level on a sub-field in which a sustaining period is omitted; and said plasma display panel for displaying the mapped data.

The apparatus further includes means for making an inverse gamma correction of an input image; means for making an error diffusion of the inverse gamma corrected image; and an average picture level controller for detecting an average brightness of said input image and determining the number of sustaining pulses depending upon said average brightness to thereby control the sub-field mapping means.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
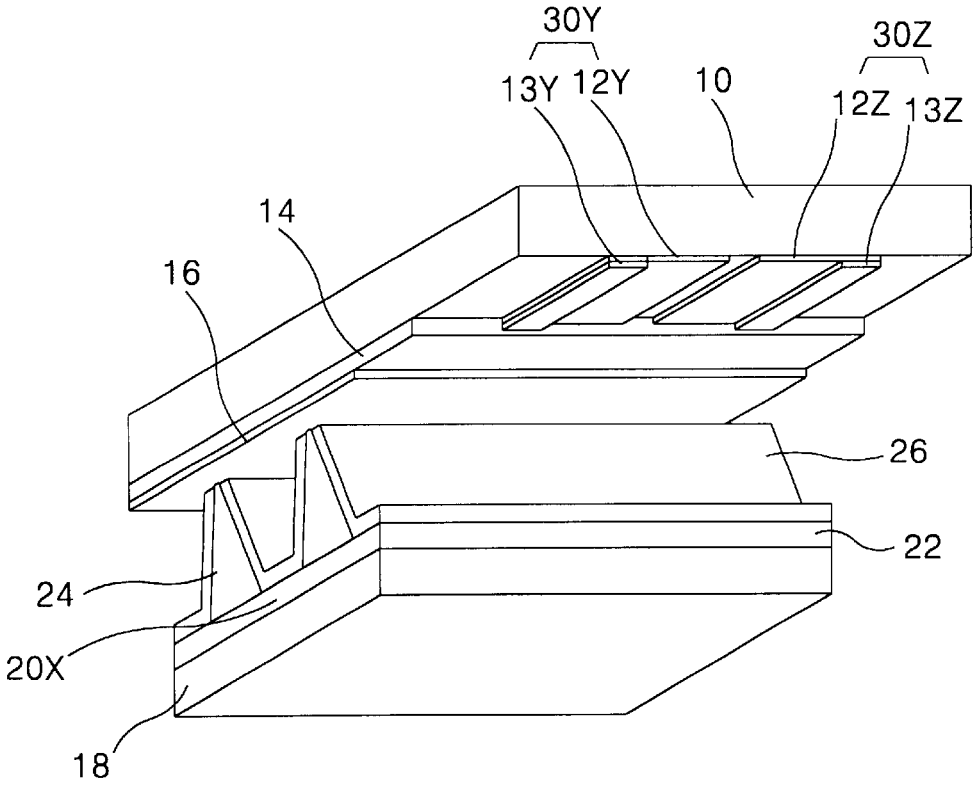
FIG. 1 CONVENTIONAL ART
FIG. 1 is a perspective view showing a discharge cell structure of a conventional three-electrode, AC surface-discharge plasma display panel.
Figure 2:
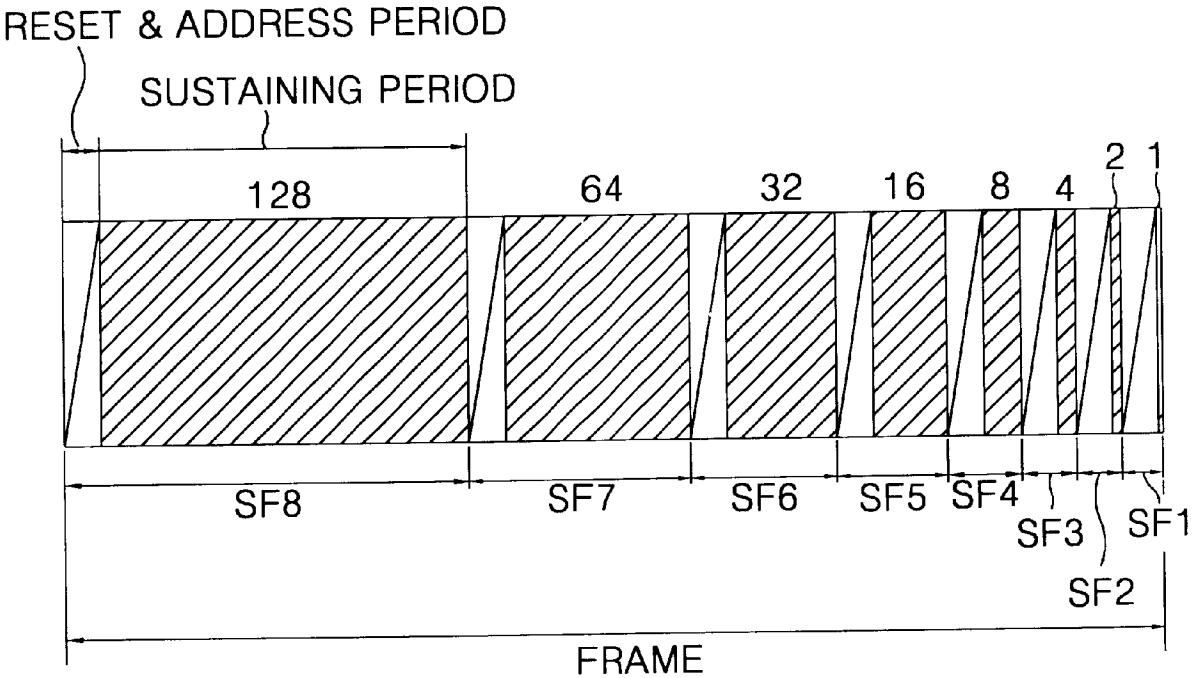
FIG.2 CONVENTIONAL ART
FIG. 2 illustrates a configuration of one frame for explaining a driving method for the plasma display panel shown in FIG. 1.
Figure 3:
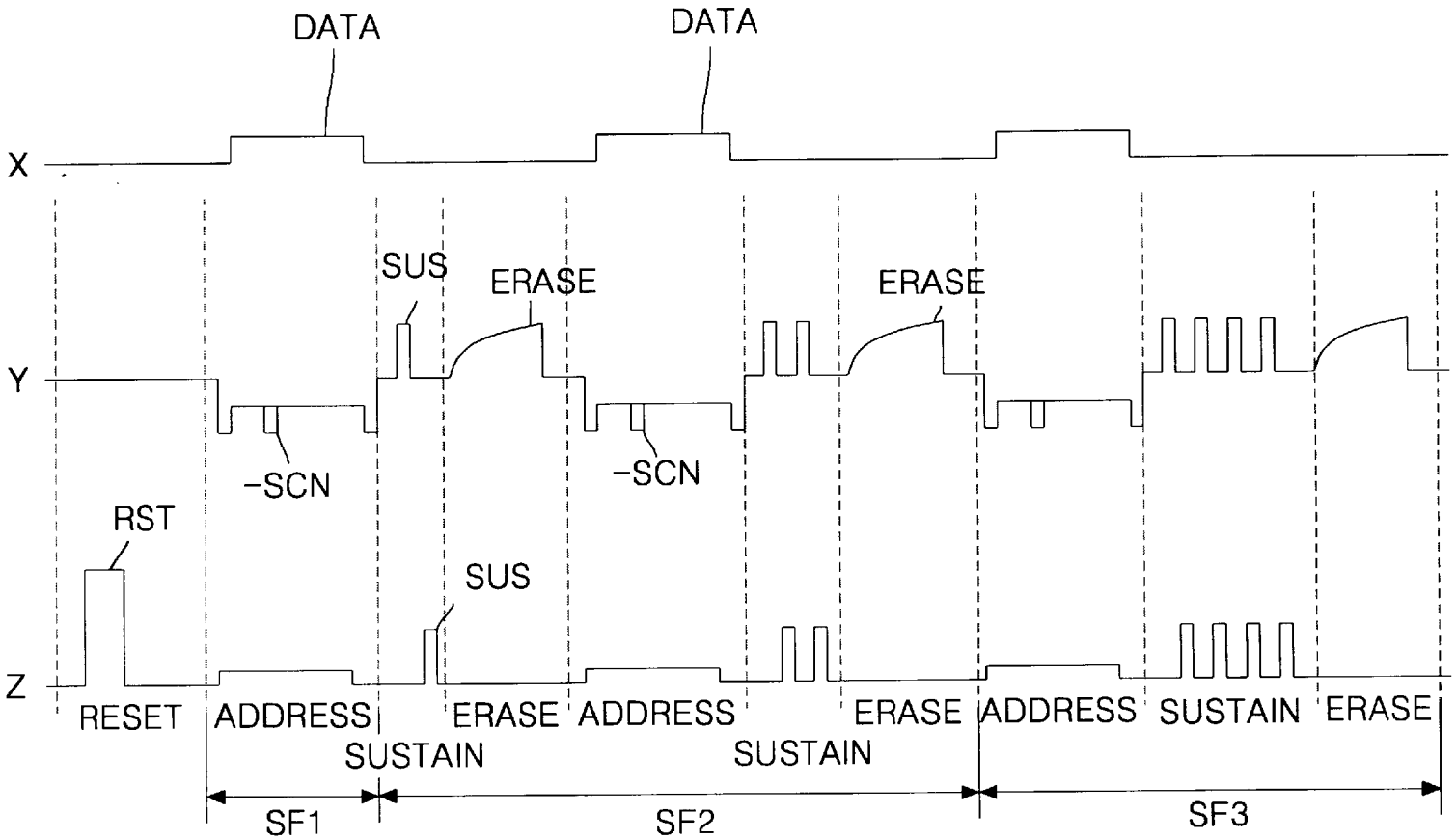
FIG.3 CONVENTIONAL ART
FIG. 3 is a waveform diagram of driving signals for the first to third sub-fields in FIG. 2.
Figure 4:
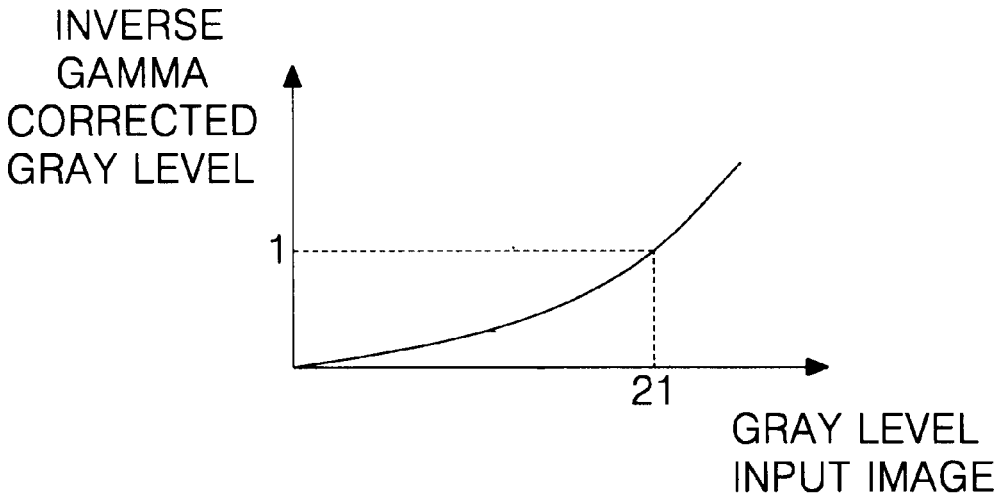
FIG. 4 CONVENTIONAL ART
FIG. 4 is a graph showing that an image with a low gray level is converted into a gray level less than 1 by an inverse gamma correction.
Figure 5:
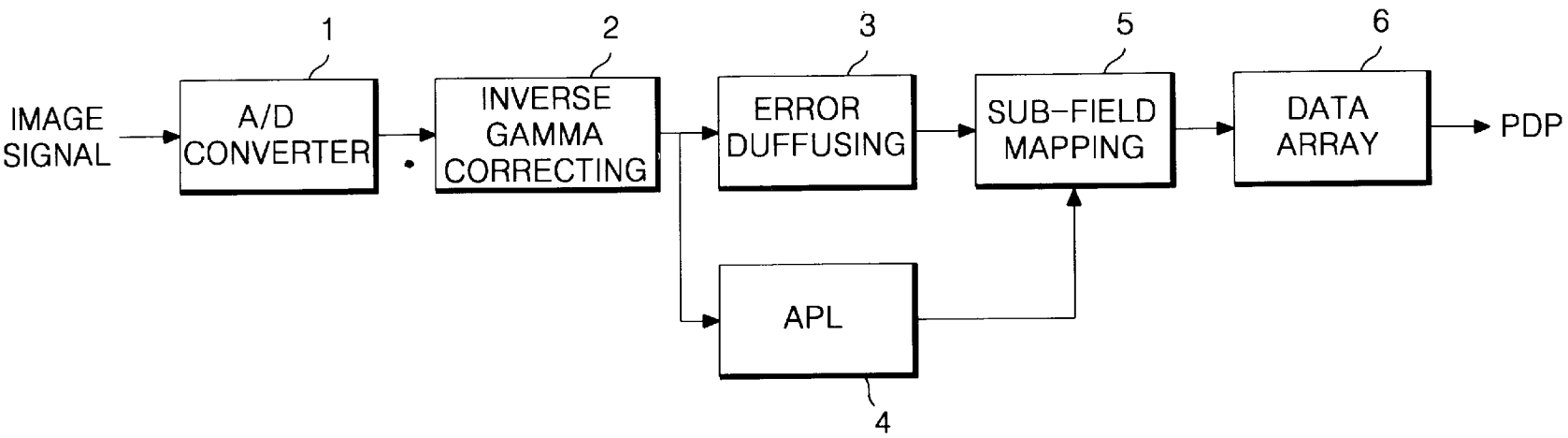
FIG. 5 is a block diagram showing an expression of a gray level with a decimal value in a plasma display panel according to the present invention.

Referring to FIG. 5, there is shown an apparatus for expressing a gray level with a decimal value in a plasma display panel (PDP) according to an embodiment of the present invention.

The present apparatus includes a digital converter 1, hereinafter referred to as "A/D converters", for converting an input image into a digital data, a data array 6 for supplying a data driving circuit of the PDP (not shown) with a data, an inverse gamma corrector 2, an error diffuser 3 and a sub-field mapping device 5 that are connected between the A/D converter 1 and the data array 6, and an average picture level controller (APL) 4 connected between the inverse gamma corrector 2 and the sub-field mapping device 5.

The A/D converter 1 converts red, green and blue input picture data into digital data and supplies them to the inverse gamma corrector 2. The inverse gamma corrector 2 makes an inverse gamma correction of an input image signal to linearly convert a gray level of an image signal. The error diffuser 3 plays a role to diffuse an error component into adjacent cells to finely control a brightness value. To this end, the error diffuser 3 divides a data into a fixed number part and a decimal part and multiplies the decimal part by a Floy-Steinberg coefficient, thereby diffusing an error component into the adjacent cells.

A plurality of sub-field arrangements, each having the number of sustaining pulses and the total number of gray levels different from each other, has been stored in the sub-field mapping device 6 in advance. Each of sub-field arrangements having a low number of sustaining pulses in a plurality of sub-field arrangements stored in the sub-field mapping device 6 includes a sub-field given by a brightness weighting value less than 1 so as to express a gray level with a decimal value, along with a plurality of sub-fields given by a brightness weighting value with an integer. The sub-field mapping device 6 maps a data inputted from the error diffuser 5 on each sub-field in accordance with a gray level value, and selects an sub-field arrangement in accordance with an information about the number of sustaining pulses inputted from the APL 4.

The data array 6 distributes a data inputted from the sub-field mapping device 5 and divisionally provides the distributed data for each integrated circuit (IC) of a plurality of driving IC's.

An information about the number of sustaining pulses divided in a multiple step in accordance with an average brightness of an input image signal has been stored in the APL 4. The APL 4 calculates an average brightness of one frame data, that is, a data for one field undergoing an inverse gamma correction and selects the predetermined number of sustaining pulses in accordance with the average brightness, thereby controlling the sub-field mapping device. With the aid of the AFL 4, the total number of sustaining pulses is reduced when an average brightness of an input image is high, whereas the total number of sustaining pulses is enlarged when an average brightness of an input image is low.

The following Table 3 represents sub-field arrangements stored in the sub-field mapping device 5 when it is assumed that the number of sub-fields should be at most 14. Each sub-field arrangement is selected in accordance with an average brightness of an input image.

TABLE 3

| | SF1 | SF2 | SF3 | SF4 | SF5 | SF6 | SF7 | SF8 | SF9 | SF10 | SF11 | SF12 | SF13 | SF14 |
|---|---|---|---|---|---|---|---|---|---|---|---|---|---|---|
| 1023 | 1 | 2 | 4 | 8 | 16 | 32 | 64 | 128 | 128 | 128 | 128 | 128 | 128 | 128 |
| 885 | 1 | 2 | 3 | 7 | 14 | 28 | 56 | 112 | 112 | 112 | 112 | 112 | 112 | 112 |
| 767 | 1 | 1 | 3 | 6 | 12 | 24 | 48 | 96 | 96 | 96 | 96 | 96 | 96 | 96 |
| 639 | 1 | 1 | 2 | 5 | 10 | 20 | 40 | 80 | 80 | 80 | 180 | 80 | 80 | 80 |
| 511.5 | 0.5 | 1 | 2 | 4 | 8 | 16 | 32 | 64 | 64 | 64 | 64 | 64 | 64 | 64 |
| 383.5 | 0.5 | 1 | 1 | 3 | 6 | 12 | 24 | 48 | 48 | 48 | 48 | 48 | 48 | 48 |
| 255.75 | 0.25 | 0.5 | 1 | 2 | 4 | 8 | 16 | 32 | 32 | 32 | 32 | 32 | 32 | 32 |

In the Table 3, the uppermost row represents sub-fields while the leftmost column represents the total number of sustaining pulses. As can be seen from the Table 3, sub-fields having a brightness weighting value with a decimal value are included in sub-fields arrangements in which the total numbers of sustaining pulse pairs are 383.5, 511.5 and 255.25. Accordingly, an image signal of a gray level converted into less than 1 by an inverse gamma correction can not only be normally displayed, but also a decimal value between integers can be expressed. In the mean time, the first sub-field SF1 given by a brightness weighting value of 0.25 is removed from the sub-field arrangement in which the total number of sustaining pulse pairs is 255.75, to thereby produce a sub-field arrangement in which the total number of sustaining pulse pairs is 255.5.

The following Table 4 represents a gray level expressed in the sub-field arrangement in which the total number of sustaining pulse pairs is 255.75, and the following Table 5 represents a gray level expressed in the sub-field arrangement in which the total number of sustaining pulse pairs is 255.5.

TABLE 4

| | SF1 (0.25) | SF2 (0.5) | SF3 (1) | SF4 (2) | SF5 (4) | SF6 (8) | SF7 (16) | SF8 (32) | SF9 (32) | SF10 (32) | SF11 (32) | SF12 (32) | SF13 (32) | SF14 (32) |
|---|---|---|---|---|---|---|---|---|---|---|---|---|---|---|
| 0 | x | x | x | x | x | x | x | x | x | x | x | x | x | x |
| 0.25 | 0 | x | x | x | x | x | x | x | x | x | x | x | x | x |
| 0.5 | x | 0 | x | x | x | x | x | x | x | x | x | x | x | x |
| 0.75 | 0 | 0 | x | x | x | x | x | x | x | x | x | x | x | x |
| 1 | x | x | 0 | x | x | x | x | x | x | x | x | x | x | x |
| 1.25 | 0 | x | 0 | x | x | x | x | x | x | x | x | x | x | x |
| 1.5 | x | 0 | 0 | x | x | x | x | x | x | x | x | x | x | x |
| 1.75 | 0 | 0 | 0 | x | x | x | x | x | x | x | x | x | x | x |
| 2 | x | x | x | 0 | x | x | x | x | x | x | x | x | x | x |
| . | . | . | . | . | . | . | . | . | . | . | . | . | . | . |
| . | . | . | . | . | . | . | . | . | . | . | . | . | . | . |
| . | . | . | . | . | . | . | . | . | . | . | . | . | . | . |
| 254 | x | x | x | 0 | 0 | 0 | 0 | 0 | 0 | 0 | 0 | 0 | 0 | 0 |
| 254.25 | 0 | x | x | 0 | 0 | 0 | 0 | 0 | 0 | 0 | 0 | 0 | 0 | 0 |
| 254.5 | x | 0 | x | 0 | 0 | 0 | 0 | 0 | 0 | 0 | 0 | 0 | 0 | 0 |
| 254.75 | 0 | 0 | x | 0 | 0 | 0 | 0 | 0 | 0 | 0 | 0 | 0 | 0 | 0 |
| 255 | x | x | 0 | 0 | 0 | 0 | 0 | 0 | 0 | 0 | 0 | 0 | 0 | 0 |
| 255.25 | 0 | x | 0 | 0 | 0 | 0 | 0 | 0 | 0 | 0 | 0 | 0 | 0 | 0 |
| 255.5. | | 0 | 0 | 0 | 0 | 0 | 0 | 0 | 0 | 0 | 0 | 0 | 0 | 0 |
| 255.75 | 0 | 0 | 0 | 0 | 0 | 0 | 0 | 0 | 0 | 0 | 0 | 0 | 0 | 0 |

TABLE 5

| | SF1 (0.5) | SF2 (1) | SF3 (2) | SF4 (4) | SF5 (8) | SF6 (16) | SF7 (32) | SF8 (32) | SF9 (32) | SF10 (32) | SF11 (32) | SF12 (32) | SF13 (32) |
|---|---|---|---|---|---|---|---|---|---|---|---|---|---|
| 0 | x | x | x | x | x | x | x | x | x | x | x | x | x |
| 0.5 | 0 | x | x | x | x | x | x | x | x | x | x | x | x |
| 1 | x | 0 | x | x | x | x | x | x | x | x | x | x | x |
| 1.5 | 0 | 0 | x | x | x | x | x | x | x | x | x | x | x |
| 2 | x | x | 0 | x | x | x | x | x | x | x | x | x | x |

TABLE 5-continued

| | SF1 (0.5) | SF2 (1) | SF3 (2) | SF4 (4) | SF5 (8) | SF6 (16) | SF7 (32) | SF8 (32) | SF9 (32) | SF10 (32) | SF11 (32) | SF12 (32) | SF13 (32) |
|---|---|---|---|---|---|---|---|---|---|---|---|---|---|
| . | . | . | . | . | . | . | . | . | . | . | . | . | . |
| . | . | . | . | . | . | . | . | . | . | . | . | . | . |
| . | . | . | . | . | . | . | . | . | . | . | . | . | . |
| 254 | x | x | 0 | 0 | 0 | 0 | 0 | 0 | 0 | 0 | 0 | 0 | 0 |
| 254.5 | 0 | x | 0 | 0 | 0 | 0 | 0 | 0 | 0 | 0 | 0 | 0 | 0 |
| 255 | x | 0 | 0 | 0 | 0 | 0 | 0 | 0 | 0 | 0 | 0 | 0 | 0 |
| 255.5 | 0 | 0 | 0 | 0 | 0 | 0 | 0 | 0 | 0 | 0 | 0 | 0 | 0 |

In the Table 4 and Table 5, the uppermost row represents sub-fields and their brightness weighing values while the leftmost column represents the number of sub-field pairs. Further, '0' indicates turned-on sub-fields SF1 to SF14 while 'x' represents turned-off sub-fields.

Figure 6:
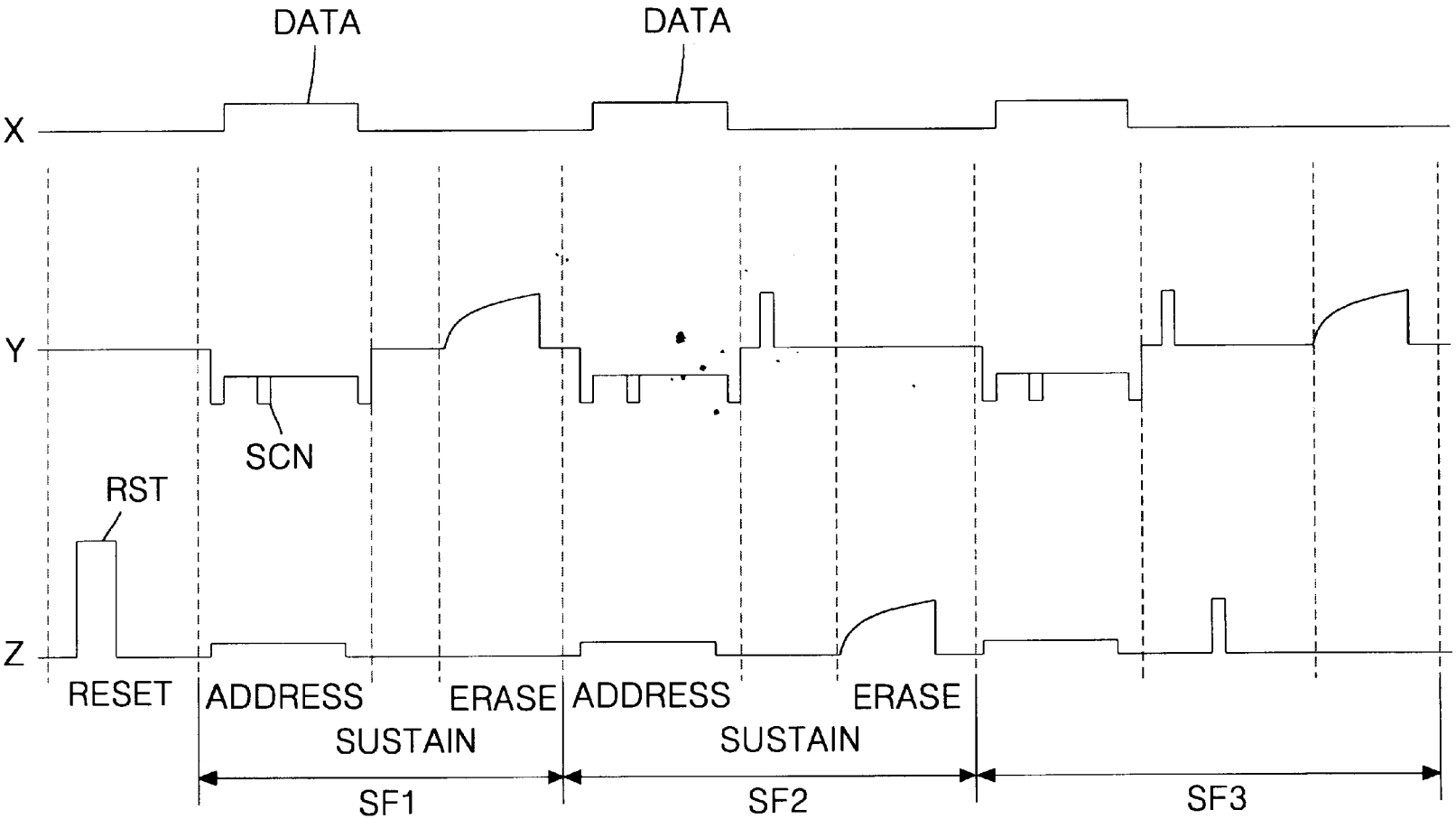
FIG. 6 illustrates a driving waveform for explaining a method of expressing a gray level with a decimal value in a plasma display panel according to a first embodiment of the present invention.

FIG. 6 shows a driving waveform, for explaining a method of expressing a gray level with a decimal value in a PDP according to a first embodiment of the present invention.

Referring to FIG. 6, a reset period for initializing a panel is assigned at an initial time of the frame. In the reset period, a high positive reset pulse RST or a setup/set-down pulse (not shown) taking a ramp wave shape having a desired slope is applied to the sustaining electrode Z to cause a reset discharge within cells of the panel. This reset discharge allows wall charges to be uniformly accumulated in the cells of the panel, so that a discharge characteristic becomes uniform The first sub-field SF1 has a brightness weighting value set to '0.25'. In the address period of the first sub-field SF1, a data pulse DATA is applied to the address electrode X and a scanning pulse-SCN is sequentially applied to the scanning electrode Y in such a manner to be synchronized with the data pulse DATA. A voltage difference between the data pulse DATA and the scanning pulse-SCN is added to a wall voltage within the cells, thereby allowing the cells supplied with the data pulse DATA to cause an address discharge. In the sustaining period of the first sub-field SF1, a sustaining pulse SUS is not applied. In the erase period of the first sub-field SF1, an erase signal with a shape of ramp wave is simultaneously applied to all the scanning electrodes Y. This erase signal is applied to the scanning electrode Y to generate a minute discharge with the sustaining electrode Z so as to eliminate negative wall charges accumulated in the sustaining electrode z prior to the erase period. The first sub-field SF1 expresses a gray level value '0.25' only by an emission amount accompanied during an address discharge without any sustaining discharge.

The second sub-field SF2 has a brightness weighting value set to '0.5'. In the address period of the second sub-field SF2, a data pulse DATA is applied to the address electrode X and a scanning pulse-SCN is sequentially applied to the scanning electrode Y in such a manner to be synchronized with the data pulse DATA. A voltage difference between the data pulse DATA and the scanning pulse-SCN is added to a wall voltage within the cells, thereby allowing the cells supplied with the data pulse DATA to cause an address discharge. In the sustaining period of the second sub-field SF2, a sustaining pulse SUS is applied only to the scanning electrode Y. In the erase period of the second sub-field SF2, an erase signal with a shape of a ramp wave is simultaneously applied to the sustaining electrode Z. This erase signal is applied to the sustaining electrode Z to generate a minute discharge with the scanning electrode Y for the purpose of eliminating negative wall charges accumulated in the sustaining electrode Z prior to the erase period. The second sub-field SF2 expresses a gray level value '0.5' owing to once sustaining discharge caused by a sustaining pulse SUS applied to the scanning electrode Y once.

The third sub-field SF3 has a brightness weighting value set to '1'. In the address period of the third sub-field SF3, a data pulse DATA is applied to the address electrode X and a scanning pulse-SCN is sequentially applied to the scanning electrode Y in such a manner to be synchronized with the data pulse DATA. A voltage difference between the data pulse DATA and the scanning pulse-SCN is added to a wall voltage within the cells, thereby allowing the cells supplied with the data pulse DATA to cause an address discharge. In the sustaining period of the third sub-field SF3, a sustaining pulse SUS is applied to the sustaining electrode Z after it was applied to the scanning electrode Y. In the erase period of the third sub-field SF3, an erase signal with a shape of ramp wave is simultaneously applied to all the scanning electrodes Y. This erase signal is applied to the scanning electrode Y to generate a minute discharge with the sustaining electrode Z for the purpose of eliminating negative wall charges accumulated in the sustaining electrode Z prior to the erase period. The third sub-field SF3 expresses a gray level value '1' by sustaining discharges generated successively twice by a pair of sustaining pulses SUS.

After the third sub-field SF3, a plurality of sub-fields given by brightness weighting values with an integer are succeeded.

Figure 7:
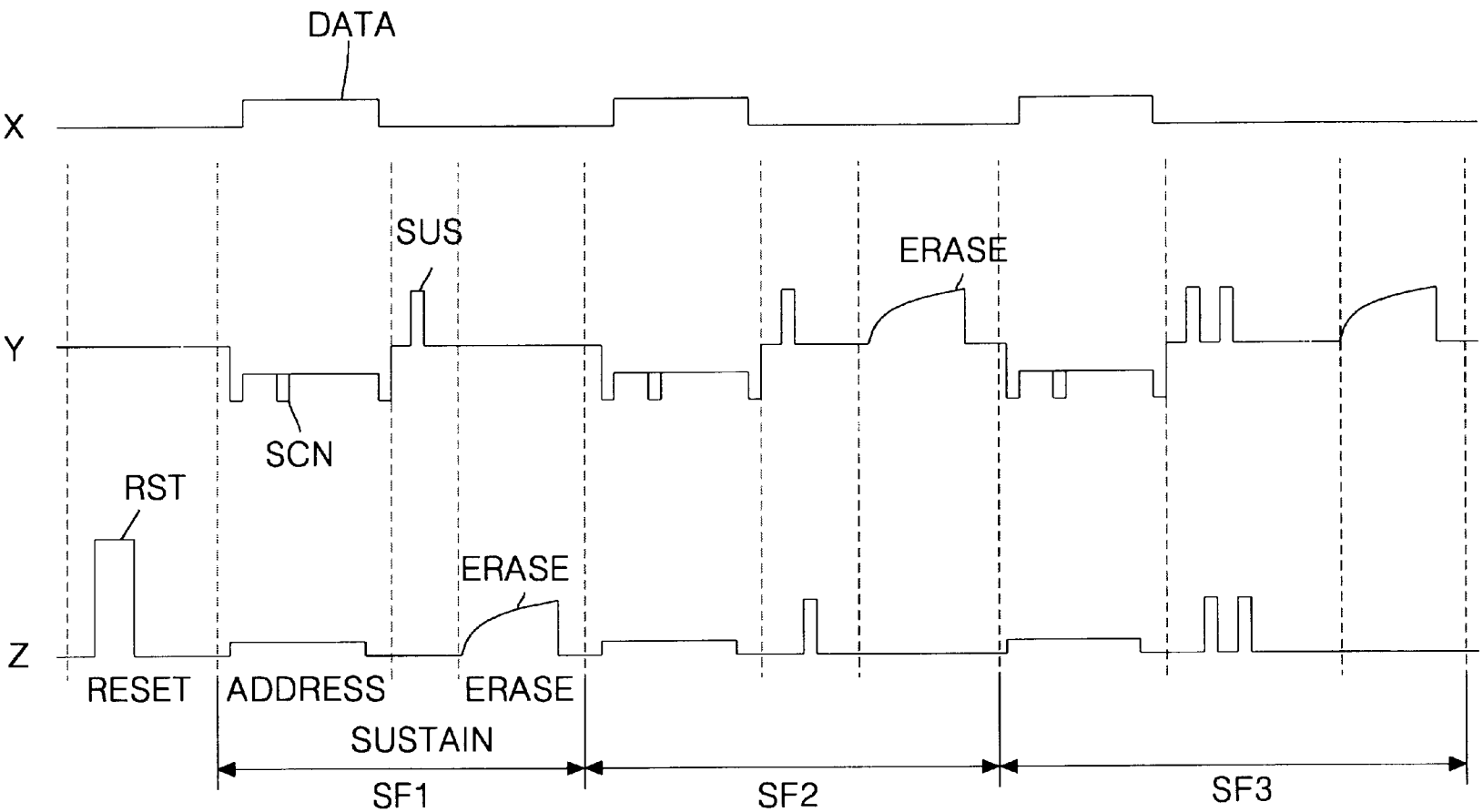
FIG. 7 illustrates a driving waveform for explaining a method of expressing a gray level with a decimal value in a plasma display panel according to a second embodiment of the present invention.

FIG. 7 shows a driving waveform for explaining a method of expressing a gray level with a decimal value in a PDP according to a second embodiment of the present invention.

Referring to FIG. 7, a reset period for initializing a panel is assigned at an initial time of the frame. In the reset period, a high positive reset pulse RST or a setup/set-down pulse (not shown) taking a ramp wave shape having a desired slope is applied to the sustaining electrode Z to cause a reset discharge within cells of the panel. This reset discharge allows wall charges to be uniformly accumulated in the cells of the panel, so that a discharge characteristic becomes uniform.

The first sub-field SF1 has a brightness weighting value set to '0.5'. In the address period of the first sub-field SF1, a data pulse DATA is applied to the address electrode X and a scanning pulse-SCN is sequentially applied to the scanning electrode Y in such a manner to be synchronized with the data pulse DATA. A voltage difference between the data pulse DATA and the scanning pulse-SCN is added to a wall voltage within the cells, thereby allowing the cells supplied with the data pulse DATA to cause an address discharge. In the sustaining period of the first sub-field SF1, a sustaining pulse SUS is applied only to the scanning electrode Y. In the erase period of the first sub-field SF1, an erase signal with a shape of ramp wave is simultaneously applied to the sustaining electrode Z. This erase signal is applied to the sustaining electrode Z to generate a minute discharge with the scanning electrode Y so as to eliminate negative wall charges accumulated in the scanning electrode Y prior to the erase period. The first sub-field SF1 expresses a gray level value '0.5' by once sustaining discharge caused by a sustaining pulse SUS applied to the scanning electrode Y once.

The second sub-field SF2 has a brightness weighting value set to '1'. In the address period of the second sub-field SF2, a data pulse DATA is applied to the address electrode X and a scanning pulse-SCN is sequentially applied to the scanning electrode Y in such a manner to be synchronized with the data pulse DATA. A voltage difference between the data pulse DATA and the scanning pulse-SCN is added to a wall voltage within the cells, thereby allowing the cells supplied with the data pulse DATA to cause an address discharge. In the sustaining period of the second sub-field SF2, a sustaining pulse SUS is applied to the sustaining electrode Z after it was applied to the scanning electrode Y. In the erase period of the second sub-field SF2, an erase signal with a shape of ramp wave is simultaneously applied to all the scanning electrodes Y.

This erase signal is applied to the scanning electrode Y to generate a minute discharge with the sustaining electrode Z for the purpose of eliminating negative wall charges accumulated in the sustaining electrode Z prior to the erase period. The second sub-field SF2 expresses a gray level value '1' owing to a sustaining discharge caused successively twice by a pair of sustaining pulses SUS.

The third sub-field SF3 has a brightness weighting value set to '2'. In the address period of the third sub-field SF3, a data pulse DATA is applied to the address electrode X and a scanning pulse-SCN is sequentially applied to the scanning electrodes Y in such a manner to be synchronized with the data pulse DATA. A voltage difference between the data pulse DATA and the scanning pulse-SCN is added to a wall voltage within the cells, thereby allowing the cells supplied with the data pulse DATA to cause an address discharge. In the sustaining period of the third sub-field SF3, sustaining pulses SUS, that is, two pairs of sustaining pulses are alternately applied to the scanning electrode Y and the sustaining electrode Z four times. In the erase period of the third sub-field SF3, an erase signal with a shape of ramp wave is simultaneously applied to all the scanning electrodes Y. This erase signal is applied to the scanning electrode Y to generate a minute discharge with the sustaining electrode Z for the purpose of eliminating negative wall charges accumulated in the sustaining electrode Z prior to the erase period. The third sub-field SF3 expresses a gray level value '2' by sustaining discharges generated successively twice by two pairs of sustaining pulses.

After the third sub-field SF3, a plurality of sub-fields given by brightness weighting values with an integer are succeeded.

Meanwhile, as can be seen from FIG. 6 and FIG. 7, in a method of expressing a gray level with a decimal value in the PDP according to the present invention, sustaining pulses set to the sub-field given by a decimal brightness weighting value do not make a pair. Accordingly, the total number of sustaining pulses applied to each of the scanning electrode Y and the sustaining electrode Z within one frame by the sub-field given by a decimal brightness weighting value is set to be different from each other.

As described above, according to the present invention, a decimal brightness weighting value is given to a sub-field, and a sustaining pulse is not set to the sub-field or the number of sustaining pulses applied to the scanning electrode Y and the sustaining electrode Z is set to be different from each other. As a result, according to the present invention, a gray level with a decimal value, particularly, a picture converted into a brightness less than 1 by an inverse gamma correction can not only be normally displayed, but also an error diffusion artifact caused by an error diffusion can be reduced to improve a picture quality, Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A method of providing a gray level in a plasma display panel having a sustaining electrode pair for causing a sustaining discharge with respect to a selected cell, wherein a sustaining pulse is applied to only one electrode of the sustaining electrode pair, in at least one sub-field.

2. The method as claimed in claim 1, wherein at least one sub-field includes an erase period for applying an erase signal to other sustaining electrode opposed to the sustaining electrode supplied with the sustaining pulse to erase said discharge.

3. The method as claimed in claim 1, wherein at least one sub-field includes a reset period for initializing the panel.

4. The method as claimed in claim 1, wherein at least one sub-field of a frame is used for providing the gray level and has the least brightness relative to other sub-fields of the frame.

5. The method as claimed in claim 1, wherein the sustaining pulse controls a brightness for the at least one sub-field.

6. The method as claimed in claim 1, wherein the at least one sub-field at which the sustaining pulse is applied only to any one electrode of the sustaining electrode pair includes at least one of a reset period for initializing a cell, an address period for selecting the cell, a portion of a sustain period at which the sustaining pulse is applied and an erasure period for erasing the cell.

7. The method as claimed in claim 1, wherein the sustaining discharge is created based on a potential difference between the sustaining pulse applied to only one of the electrode pair and the other electrode of the pair.

8. The method as claimed in claim 1, wherein the sustain discharge creates the greatest brightness within the at least one sub-field.

9. The method as claimed in claim 1, wherein a frame includes a plurality of sub-fields, and a combination of the plurality of sub-fields is used to create a plurality of gray levels.

10. A method of providing a gray level by dividing a frame into a plurality of sub-fields in a plasma display panel, wherein a sustaining period is omitted in at least one sub-field, said at least one sub-field having an address period for an address discharge.

11. The method as claimed in claim 10, wherein the at least one sub-field for providing said gray level includes a reset period for initializing the panel.

12. The method as claimed in claim 10, wherein the at least one sub-field provides said gray level based only on a brightness caused by a light emission of an address discharge.

13. The method as claimed in claim 10, wherein the at least one sub-field of a frame for providing said gray level has the least brightness relative to other sub-fields of the frame.

14. The method as claimed in claim 10, wherein the at least one sub-field at which the sustain period is omitted further includes at least one of a reset period for initializing a cell and an erasure period for erasing the cell.

15. The method as claimed in claim 10, wherein the address discharge controls a brightness for the at least one sub-field.

16. The method as claimed in claim 10, wherein a combination of the plurality of sub-fields is used to create a plurality of gray levels.

17. A method of providing a gray level by dividing a frame into a plurality of sub-fields in a plasma display panel, comprising:

determining the number of first sustaining pulses corresponding to a first gray level 'n' (wherein n is a specific value );

determining the number of second sustaining pulses corresponding to a second gray level 'n+1'; and determining the number of third sustaining pulses corresponding to a brightness value between said first and second gray levels 'n' and 'n+1', wherein the number of third sustaining pulses is determined by a value between the number of first sustaining pulses and the number of second sustaining pulses.

18. A method of expressing a gray level by dividing a frame into a plurality of sub-fields in a plasma display panel, comprising:

determining the number of first sustaining pulses corresponding to a first sustaining electrode;

determining the number of second sustaining pulses corresponding to a second sustaining electrode making a pair with respect to the first sustaining electrode, said number of second sustaining pulses being different from the number of first sustaining pulses; and applying the first sustaining pulses to the first sustaining electrode and applying the second sustaining pulses to the second sustaining electrode to provide a brightness between a gray level 'n' (wherein n is a specific value) and a gray level 'n+1'.

19. An apparatus for expressing a gray level using a frame having a plurality of sub-fields in a plasma display panel, comprising:

said plasma displayed panel having a sustaining electrode pair for causing a sustaining discharge with respect to a selected cell; and sub-field mapping means for mapping a data according to a brightness value between a gray level 'n' (wherein n is a specific value) and a gray level 'n+1' into at least one of sub-fields at which a sustaining pulse is to only one electrode of said sustaining electrode pair.

20. The apparatus as claimed in claim 19, further comprising:

means for making an error diffusion of the inverse gamma corrected image; and an average picture level controller for detecting an average brightness of said input image and determining the number of sustaining pulses depending upon said average brightness to thereby control the sub-field mapping means.

21. An apparatus for expressing a gray level using a frame having a plurality of sub-fields in a plasma display panel, comprising:

sub-field mapping means for mapping an image data according to a brightness value between a gray level 'n' (wherein n is a specific value) and a gray level 'n+1' into at least one of sub-fields at which a sustaining period is omitted at at least one of sub-field, at least one sub-field having an address period for an address discharge; and said plasma display panel for displaying the mapped data.

22. The apparatus as claimed in claim 21, further comprising:

means for making an inverse gamma correction of an input image;

means for making an error diffusion of the inverse gamma corrected image; and an average picture level controller for detecting an average brightness of said input image and determining the number of sustaining pulses depending upon said average brightness to thereby control the sub-field mapping means.

* * * * *